United States Patent [19]

Seely

[11] Patent Number: 4,523,400

[45] Date of Patent: Jun. 18, 1985

[54] PLASTIC BIASED POSTER FRAME

[75] Inventor: James R. Seely, Avon, Conn.

[73] Assignee: Marketing Displays, Inc., Farmington Hills, Mich.

[21] Appl. No.: 592,903

[22] Filed: Mar. 23, 1984

Related U.S. Application Data

[63] Continuation of Ser. No. 424,883, Sep. 27, 1982, abandoned.

[51] Int. Cl.[3] ..... A47G 1/06

[52] U.S. Cl. ..... 40/156; 40/13

[58] Field of Search ..... 40/156, 13; 24/67.3, 24/67.7, 292; 52/400; 16/225, 227

[56] References Cited

U.S. PATENT DOCUMENTS

| | | | |
|---|---|---|---|
| 2,603,017 | 7/1952 | Merrill | 40/152 |
| 2,882,633 | 4/1959 | Howell | 40/156 |
| 3,070,914 | 1/1963 | Henderson et al. | 40/156 |
| 3,205,601 | 9/1965 | Gawne et al. | 40/13 |
| 3,310,901 | 3/1967 | Sarkisian | 40/13 |
| 3,360,893 | 1/1968 | Wattelez | 40/156 X |
| 3,386,198 | 6/1968 | Howell | 40/156 |
| 3,720,979 | 3/1973 | Krawagna | 16/227 |
| 4,038,770 | 8/1977 | Bott | 40/209 |
| 4,145,828 | 3/1979 | Hillstrom | 40/156 |
| 4,237,632 | 12/1980 | Segerstad | 40/156 |
| 4,358,917 | 11/1982 | Oda et al. | 52/400 |
| 4,364,192 | 12/1982 | Lloyd | 40/155 |

FOREIGN PATENT DOCUMENTS

| | | | |
|---|---|---|---|
| 835010 | 2/1970 | Canada | 16/225 |
| 1056999 | 2/1967 | United Kingdom | 16/225 |
| 1295378 | 11/1972 | United Kingdom . | |
| 2005535A | 4/1979 | United Kingdom . | |

*Primary Examiner*—Robert P. Swiatek
*Assistant Examiner*—Cary E. Stone
*Attorney, Agent, or Firm*—Harness, Dickey & Pierce

[57] ABSTRACT

A plastic poster frame and display holder for replaceable posters, pictures and similar advertising or decorative material has extruded frame forming sections comprising hingedly connected front and back parts. A relatively resilient elongated plastic portion is integrally formed as part of the frame section and provides a biased clamping force for holding a poster of similar display between the hinged parts.

57 Claims, 5 Drawing Figures

FIG. 1.
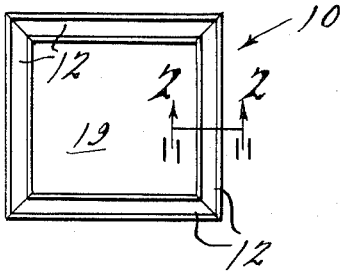
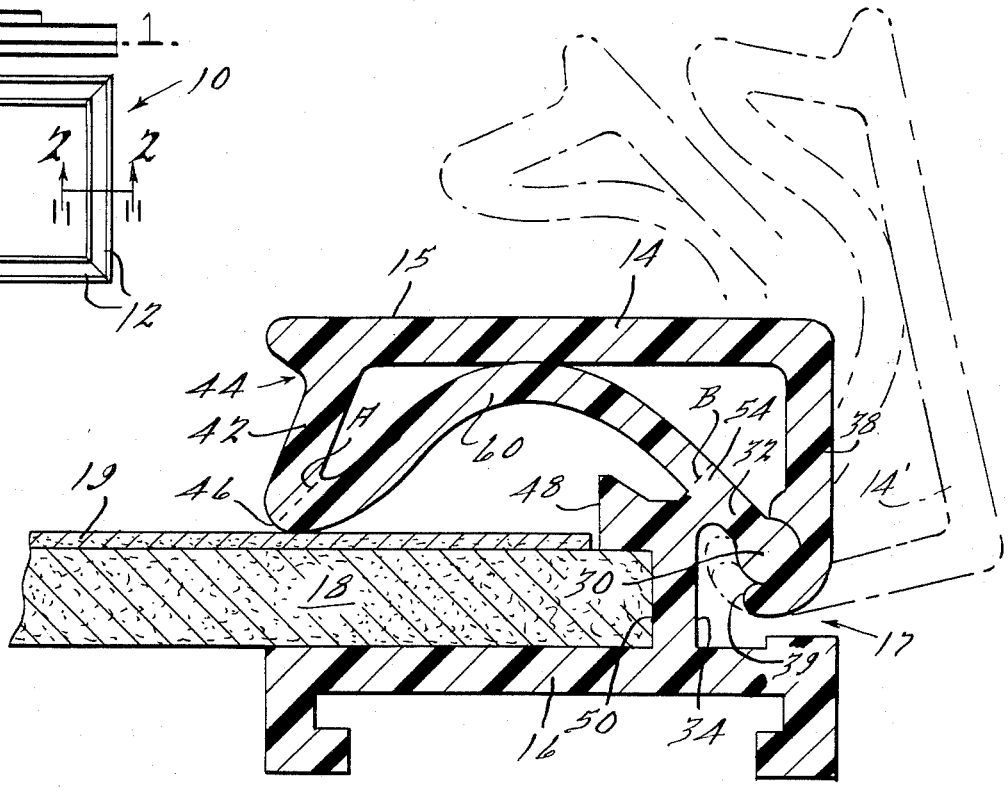
FIG. 2.
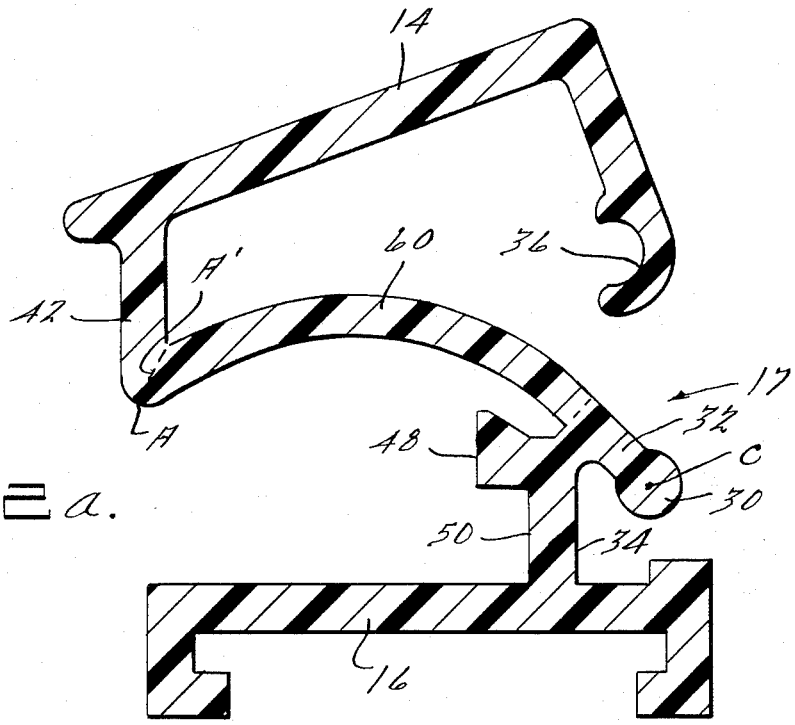
FIG. 2a.

PLASTIC BIASED POSTER FRAME

This application is a continuation of application Ser. No. 424,883, filed Sept. 27, 1982, abandoned.

BACKGROUND-SUMMARY OF THE INVENTION

The present invention relates to an improved poster frame and display holder for various types of replaceable posters, pictures and similar advertising materials. The frame and holder can be used in many various areas, such as on buses, taxi cabs, and similar mobile installations, as well as on fixed mounts such as on building walls at service stations, on posts and the like. The poster display device is neat, trim and aesthetic and capable of being used either indoors or outdoors. The device secures a poster or other message sign within its borders and allows replacement thereof in a quick and easy manner.

The present invention is an improvement over the invention disclosed and claimed in U.S. Pat. No. 4,145,828 and assigned to the assignee of the present invention. In that patent a display holder is set forth having a plurality of frame sections. Each of the sections are made essentially of two extruded portions which are pivoted together, the extruded portions being of any material which can be economically extruded, such as aluminum. The extruded frame sections are biased by means of an unbent metal leaf spring to coact and to releaseably clamp posters or similar display items in the frame. The invention as disclosed and claimed in U.S. Pat. No. 4,145,828 was itself an improvement over U.S. Pat. No. 3,310,901 which employed cantilever action-type metal leaf springs with S-shaped hooks at one end to bias together the two parts of the frame.

The present invention provides a poster frame and display holder which is less expensive to manufacture and lighter in weight than the poster frames described in the above named patents. The poster display device of the present invention also is made from a plastic material, is essentially one-piece, and is capable of providing economical frames with relatively small widths (e.g. one-half inch or smaller). In the present device a plurality of frame sections forming a polygonal frame structure are extruded of a plastic material. In the preferred embodiment each frame section comprises a one piece extrusion having a front portion and a back portion of relatively rigid plastic material adapted to be hingedly connected to one another, and having an elongated biasing section of relatively resilient plastic material forming an integral part of the frame section. The front portion has an outwardly facing surface on which a decorative simulated metal or simulated wood laminate can be secured. The back portion is formed with an upstanding flange having a pivot pintle formation thereon. The front portion is formed with an inwardly directed flange at a first end thereof and with a second inwardly directed flange at a second end thereof which includes a cup shaped formation adapted to engage the pivot pintle on the back portion and form a hinge. The elongated biasing section is coupled between the downwardly directed front flange and the upstanding flange, and forms an integral part of the one piece extrusion. The length of the elongated biasing member is such that when the pivot pintle and cup shaped formation are joined to form a hinge, the biasing member is placed under compression causing it to bow outwardly towards the front portion. The biasing member thus provides clamping forces between the front and back portion.

It is an object of the present invention to provide a unique and beneficial poster frame and display holder for use in various applications. It is another object to provide a highly durable, weather resistant poster frame and display holder which can be used indoors and outdoors and which will provide a reliable and pleasing appearance throughout its lifetime. Yet another object is to provide a display holder and poster frame which can be economically manufactured from relatively inexpensive materials. Still another object is to provide a poster display framing device which retains the effective clamping action of the inventions of U.S. Pat. Nos. 3,310,901 and 4,145,828, and yet which can be made more economically in smaller sizes.

Other objects, features, and advantages of the invention will become apparent from the following description of the invention when viewed in accordance with the accompanying drawings.

BRIEF DESCRIPTION OF THE DRAWINGS

FIG. 1 is a front view of an improved display holder in accordance with the invention;

FIG. 2 is a cross sectional view taken along the line 2—2 in FIG. 1;

FIG. 2*a* is a cross sectional view of the embodiment of FIG. 2 showing hinge member disassembled;

DESCRIPTION OF THE PREFERRED EMBODIMENTS

Figure 3:
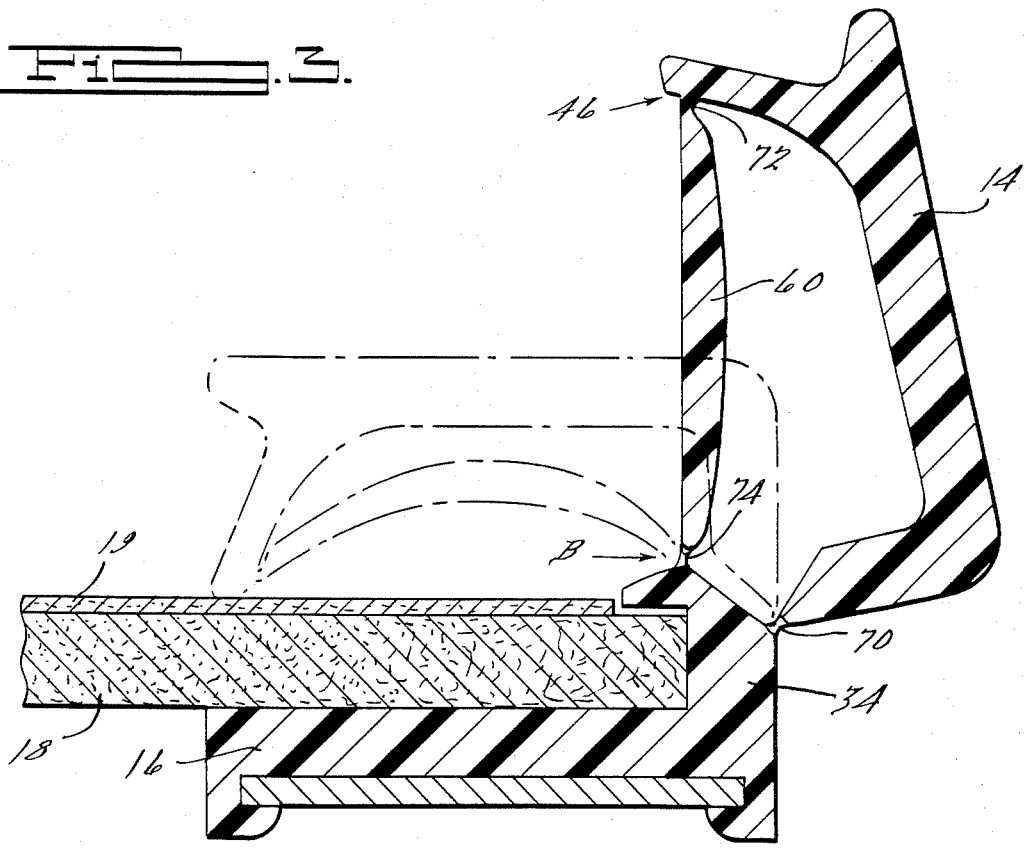
FIG. 3 is a cross sectional view of another embodiment of the invention.

As illustrated in FIG. 1, the improved display holder and poster frame, generally designated by the reference numeral 10, is made up of a plurality of frame sections 12. For a square or rectangular-shaped poster, four frame sections 12 are normally provided. The frame sections are mitered 45 degrees at their ends and fastened together to form a box-type frame. A backing member of hardboard, fiberboard, or metal is provided and the frame is secured on or around its edges forming the complete poster framing device. As shown in FIG. 2, each of the sections 12 is made essentially of two portions 14 and 16 being part of a common extrusion which are pivoted together as at 17. The portions 14 and 16 of each section 12 are cut to the desired length and mitered 45 degrees at their opposite ends for abutting and coplanar assembly with one another to outline the frame 10. As will be understood, the frame 10 can be square or rectangular, although it is also possible for the frame 10 to have any desired polygonal shape with an appropriate number of sections 12 mitered at appropriate angles. Also, it is possible for each of the front or cover extrusions 14 to be comprised of a number of extruded pieces of shorter length.

The frame 10 preferably has associated with it a rigid backing member 18 which can be made of plastic, masonite, aluminum or another suitable material. The sections 12 are positioned around the edges of the backing member 18 to form the completed display holder. A poster 19 or other display member is positioned on the backing member 18 and held in place around its edges by the sections 12. The back extruded portion 16 can be fastened in any conventional means to a rigid or supporting member, such as a post, wall, support frame for a vehicle, or the like. It is also understood that the use of a backing member 18 is not necessary; the frame 10 could be mounted on a flat surface forming its own backing member, or the poster 19 could be made of a rigid or stiff material without the need for a backing member.

The portions 14 and 16 are preferably made of a plastic material which can be efficiently and economically extruded, and which will present an attractive and durable structure for an indefinite length of time. Suitable materials include polypropylene, vinyl, and rigid polyvinyl chloride.

Adjacent sections 12 of the frame are held and fastened together as by glueing section to section, by glueing to the backing member 18, or by means of L-shaped corner braces as taught in U.S. Pat. No. 3,310,901, the disclosure of which is incorporated herein by reference. The outer or front portion 14 of each frame section is formed with a decorative outer surface 15 and is assembled to the back portion 16 by means of a hinge assembly denoted generally by reference numeral 17. The outer surface 15 preferably is relatively flat, but can have any decorative or ridged surface. If it is relatively flat, then it is easier to apply a simulated metal (e.g. Mylar) or simulated wood laminate to it.

The hinge assembly is comprised of a cylindrical hinge or pivot pintle formation 30 extending outwardly by bridge element 32 from an upstanding flange 34 disposed on back portion 16 and a corresponding cup shaped formation 36 formed on the back panel 38 of portion 14. The edges of the cup 36 preferably extend more than 180 degrees about the pivot 30 and the two sections 14 and 16 are snapped together after extrusion to form hinge assembly 17. As shown by dashed outlines of FIG. 2, the hinge assembly 17 allows the cover portion 14 to pivot relative to the back portion 16. When the cover portion 14 is in the position shown in solid lines in FIG. 2, it holds the poster 19 in position in the frame against the backing member 18. When it is desired to remove or replace the poster 19, the cover portion 14 is rotated or pivoted to the dashed outline position 14' permitting the removal of the poster. The rotation of portion 14 is limited by stop end 39 of cup shaped formation 36; when the portion 14 is swung to its fully open position (14') the end 39 rests against bridge element 32 (as shown by dashed outline position 39' in FIG. 2).

Extruded portion 14 has a formed side panel or flange 42 thereon with a longitudinal recess 44 formed in it. The recess 44 is provided so that the portion 14 may be grasped in manipulation to open or close it relative to portion 16. The end 46 of side panel 42 is adapted to rest on the poster 19 and clamp it in place in the display holder.

The upstanding flange 34 is formed with a lip 48 projecting orthogonally inwardly towards the center of frame 10. The upstanding flange and lip 48 form a recess 50 adapted to engage the backing member 18 around its outer edge. Lip 48 terminates with an ear 52 which provides a stop surface or guide surface useful for positioning the poster 19. The bridge 32 is attached to upstanding flange 34 and projects generally outwardly from the center of frame 10, forming a downwardly directed dogleg and terminating in pivot pintle 30. Bridge element 32 includes a knee portion 54 disposed generally opposite to the pivot pintle 36.

It will be understood that the structure thus described is extruded of a relatively rigid plastic material such as a vinyl material, including polyvinyl chloride. The invention also comprises an elongated biasing or spring portion denoted generally by reference numeral 60, which is extruded of a relatively resilient material such as estane polyurethane, or of a softer vinyl material. The elongated biasing portion 60 is integral with and coupled generally between the end 46 of side panel 42 and knee portion 54. The union between biasing portion 60 and end 46 forms a transistion A between the relatively rigid material of side panel 42 and the relatively resilient, flexible material of biasing portion 60. The union between biasing portion 60 and the knee 54 of bridge 32 forms a transition B between the relatively rigid bridge and the relatively resilient, flexible biasing portion. Preferably the unions forming transitions A and B are formed during the extrusion process, in other words, the biasing portion 60 is of the same one piece extrusion which forms the front part 14 and the back part 16.

FIG. 2*a* shows the one piece extrusion before hinge 17 is assembled. As can be seen, the frame section is extruded with the front and rear portions essentially in their open positions, but without the pivot pintle formation 30 and cup shaped formation 36 being nested together. The biasing portion 60 is extruded in a slightly bowed or arcuate configuration, although it can also be extruded in an essentially flat configuration. The running length of biasing portion 60 and bridge 32, as measured from a central point A' along interface A to point C at the center of pivot pintle 30, is made longer than the linear distance between point A' and point C. Thus when hinge 17 is assembled by snapping the cup shaped formation 36 onto the pivot pintle formation 30, the biasing portion 60 is caused to bow outwardly a significant extent (or further if extruded in a slightly bowed condition), as shown in FIG. 2. This shortens the radius of curvature of portion 60 causing it to exert an inward and outward over-center force to stably retain the movable frame front portion 14 in either its closed or its open positions. In either position, the biasing portion 60 urges the front extrusion 14 in a direction to maintain its integral cup shaped hinge formation 36 snugly against the integral pintle formation 30 of the back extrusion 16.

Another embodiment of the invention is shown in FIG. 3. In this embodiment the biasing portion 60, as well as the front portion 14 and back portion 16, are extruded of relatively rigid plastic. Again the frame section components are extruded in their "open" position, as shown in solid lines. The front portion 14 and back portion 16 are joined with a flexible living hinge 70 made from a thinner portion of the plastic material. Likewise, the biasing portion 60 is coupled to the end 46 of front piece 42 by means of a second flexible living hinge 72, and coupled to the upstanding flange 34, as at B, by means of yet another flexible living hinge 74. Preferably, all of the three living hinges are made of the same material. Whether the biasing portion 60 is made from a rigid or soft material, it functions as in the first embodiment to exert an inward and outward over-center force to stably retain the movable frame section portions in either their closed or open positions.

It will also be appreciated that in this embodiment of FIG. 3 the living hinge 70 may alternatively be replaced with the pivot pintle and integral cup shaped formation as described in connection with the first embodiment. The living hinges 72 and 74 would remain, however, at the connection of the biasing portion to the front piece 42 and to the upstanding flange 34.

Figure 4:
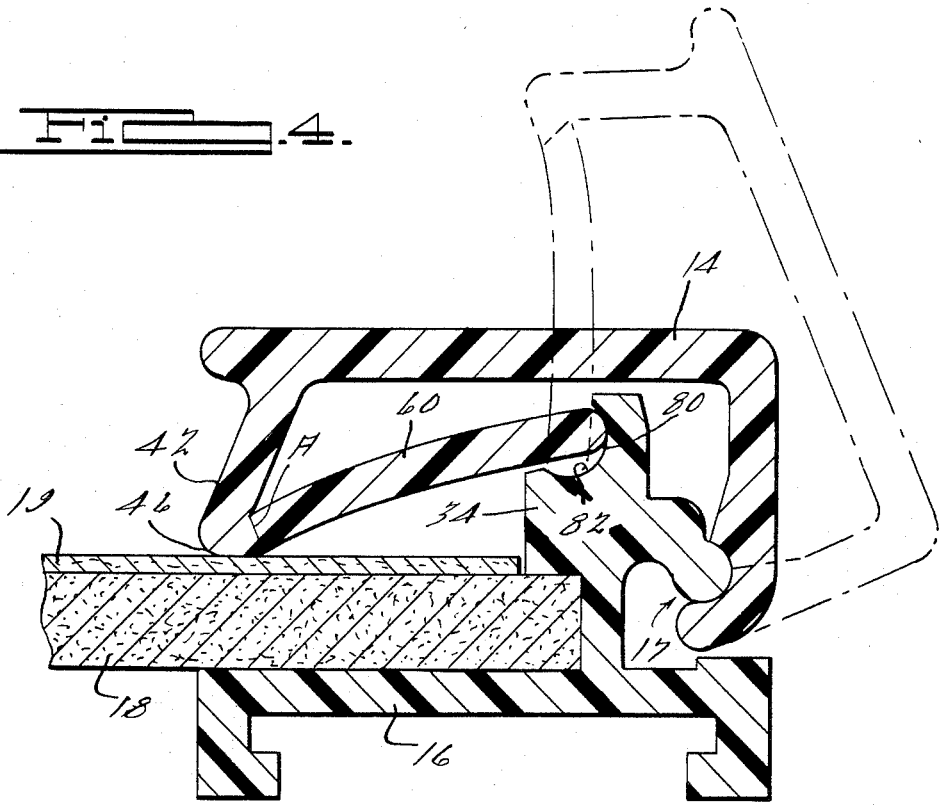
FIG. 4 is a cross sectional view of yet another embodiment of the invention.

Still another embodiment is shown in FIG. 4. This embodiment employs the pivoting hinge mechanism 17 of the first embodiment and is extruded as two pieces, although the living hinge 70 of the second embodiment may be substituted for the hinge mechanism 17 in which case a one piece extrusion would be used. The biasing portion 60 is coupled as at A to the end 46 of side panel 42 and is extruded of semi rigid plastic material forming an integral part of the front extrusion. The biasing or spring portion 60 as extruded is slighlty arcuate and terminates in a free standing rounded end portion 80. The upstanding flange 34 is formed with a longitudinal, arc shaped groove 82 adapted to pivotally engage end portion 80 upon assembly. The arcuate portion of groove 82 extends approximately 90 degrees and is positioned to allow movement of the end 80 of biasing section 60 over a 90 degree arc as the cover portion 14 is opened and closed, while preventing the end 80 from being displaced therefrom. Thus the biasing portion 60 exerts an inward and outward over-center force to stably retain the movable frame section portion in either its closed or its open position.

While specific embodiments of the invention have been illustrated and described, it will be understood that these embodiments are provided by way of example only and that the invention is not to be construed as being limited thereto, but only by the scope of the following claims.

What is claimed is:

1. A display holder having a plurality of elongated frame sections forming a polygonal frame structure for receiving and clamping a display piece in said display holder, the improvement comprising each frame section having a base member, a moveable cover member, and resilient biasing means, said cover member having holding means for securing said display piece in place, said biasing means integrally attached to both said base member and said cover member and connecting them together, said base member, cover member and biasing means being made of an extruded plastic material and being integrally formed together at the time of extrusion, said base member and cover member comprising a relatively rigid material and said biasing means comprising a relatively softer material and being elastic and resilient, said biasing means providing a force holding said holding means against said display piece.

2. The display holder according to claim 1 wherein said base member, cover member and biasing means are made from the same plastic material.

3. The display holder according to claim 1 wherein said biasing means is made from a different plastic material than said base member.

4. The display holder according to claim 1 wherein said base member and cover member are provided with integral and mating hinge formations, and said base member and cover member being assembled together in a pivotal relationship.

5. The display holder according to claim 1 wherein said base member and cover member are each attached to the biasing means at one position and pivotally attached together at another position.

6. The display holder according to claim 1 wherein said biasing means provides a first biasing force when the cover member and base member are in their closed positions thereby securing said holding means against said display piece, and said biasing means provides a second biasing force when the cover member and base member are in their open positions thereby allowing said display piece to be unsecured for removal.

7. The display holder according to claim 6 wherein said first biasing force is an over-center force and the biasing means is bowed toward said cover member.

8. The display holder according to claim 1 wherein said holding means for securing said display piece in place comprises a relatively softer material than said cover member.

9. The display holder according to claim 1 further comprising a backing member, said plurality of plastic frame sections being secured thereto to form said frame structure.

10. A closure comprising:

a first member, a second member rotatable about an axis and movable with respect to said first member between relatively open and relatively closed positions, and resilient biasing means integrally attached to both said first member and said second member for connecting them together, said first member, said second member and said biasing means being made of extruded plastic material and being integrally formed together at the time of extrusion, said first member and said second member defining a longitudinal dimension parallel to said axis and said biasing means being fully coextensive with said longitudinal dimension and said biasing means being substantially enclosed by said first and second members when disposed in said closed position, said first and second members comprising relatively rigid material and said biasing means comprising a relatively softer material and being elastic and resilient, said biasing means providing a force urging said second member toward said closed position.

11. The closure according to claim 10 wherein said first member, said second member and said biasing means are all made from the same plastic material.

12. The closure according to claim 10 wherein said biasing means is made from a different plastic material than said first member.

13. The closure according to claim 10 wherein said first member and said second member are provided with integral and mating hinge formations, said first member and said second member being assembled together in pivotal relationship.

14. The closure according to claim 10 wherein said first member and said second member are each attached to said biasing means at one position and pivotally attached together at another position.

15. The closure according to claim 10 wherein said biasing means provides a first biasing force when said second member is in said closed position and a second biasing force when said second member is in said open position.

16. The closure according to claim 15 wherein said first biasing force is an over-center force and said biasing means is bowed toward said second member.

17. The closure according to claim 15 wherein said second biasing force is directed to urge said second member toward said open position.

18. The closure according to claim 10 further comprising means for holding a display piece generally between said first and second members.

19. A display holder for receiving a display piece comprising:

a first member, a second member rotatable about an axis and movable with respect to said first member between relatively open and relatively closed positions, resilient biasing means integrally attached to both said first member and said second member for connecting them together, and means for holding said display piece, said first member, said second member and said biasing means being made of extruded plastic material and being integrally formed together at the time of extrusion, said first member and said second member defining a longitudinal dimension parallel to said axis and said biasing means being fully coextensive with said longitudinal dimension and said biasing means being substantially enclosed by said first and second members when disposed in said closed position, said first and second members comprising relatively rigid material and said biasing means comprising relatively softer material and being elastic and resilient, said biasing means providing a force urging said second member toward said closed position.

20. The display holder according to claim 19 wherein said first member, said second member and said biasing means are made from the same plastic material.

21. The display holder according to claim 19 wherein said biasing means is made from a different plastic material than said first member.

22. The display holder according to claim 19 wherein said first member and said second member are provided with integral and mating hinge formations, said first member and said second member being assembled together in pivotal relationship.

23. The display holder according to claim 19 wherein said first member and said second member are each attached to said biasing member at one position and pivotally attached together at another position.

24. The display holder according to claim 19 wherein said biasing means provides a first biasing force when said second member is in said closed position, and a second biasing force when said second member is in said open position.

25. The display holder according to claim 24 wherein said first biasing force is an over-center force and said biasing means is bowed toward said second member.

26. The display holder according to claim 24 wherein said second biasing force is in a direction urging said second member toward said open position.

27. The display holder according to claim 19 wherein said means for holding said display piece is defined by a least one of said first and second members.

28. The display holder according to claim 19 wherein said means for holding said display piece comprises a relatively softer material than said second member.

29. The display holder according to claim 19 further comprising a backing member secured to said first member.

30. The display holder according to claim 19 wherein said first member, said second member and said biasing means comprise a frame section for assembly with a plurality of other frame sections to form a polygonal frame structure.

31. A closure comprising:

a first member, a second member, hinge means for defining an axis and pivotally connecting said first and second members, said second member being movable with respect to said first member between relatively open and relatively closed positions, and resilient biasing means integrally attached to both said first member and said second member for connecting them together, said first member, said second member and said biasing means being made of extruded plastic material and being integrally formed together at the time of extrusion, said first member and said second member defining a longitudinal dimension parallel to said axis and said biasing means being fully coextensive with said longitudinal dimension and said biasing means being substantially enclosed by said first and second members when disposed in said closed position, said first and second members comprising relatively rigid material and said biasing means comprising a relatively softer material and being elastic and resilient, said biasing means providing a force urging said second member toward said closed position.

32. The closure according to claim 31 wherein said first member, said second member and said biasing means are all made from the same plastic material.

33. The closure according to claim 31 wherein said biasing means is made from a different plastic material than said first member.

34. The closure according to claim 31 wherein said first member and said second member are provided with integral and mating hinge formations, said first member and said second member being assembled together in pivotal relationship.

35. The closure according to claim 31 wherein said first member and said second member are each attached to said biasing means at one position and pivotally attached together at another position.

36. The closure according to claim 31 wherein said biasing means provides a first biasing force when said second member is in said closed position and a second biasing force when said second member is in said open position.

37. The closure according to claim 36 wherein said first biasing force is an over-center force and said biasing means is bowed toward said second member.

38. The closure according to claim 36 wherein said second biasing force is directed to urge said second member toward said open position.

39. The closure according to claim 31 further comprising means for holding a display piece generally between said first and second members.

40. The display holder according to claim 31 wherein said hinge means is integrally formed on at least one of said first and second members.

41. A display holder for receiving a display piece comprising:

a first member, a second member, hinge means for defining an axis and pivotally connecting said first and second members, said second member being movable with respect to said first member between relatively open and relatively closed positions, resilient biasing means integrally attached to both said first member and said second member for connecting them together, and means for holding said display piece, said first member, said second member and said biasing means being made of extruded plastic material and being integrally formed together at the time of extrusion, said first member and said second member defining a longitudinal dimension parallel to said axis and said biasing means being fully coextensive with said longitudinal dimension and said biasing means being substantially enclosed by said first and second members when disposed in said closed position, said first member and said second member comprising relatively rigid material and said biasing means comprising relatively softer material and being elastic and resilient, said biasing means providing a force urging said second member toward said closed position.

42. The display holder according to claim 41 wherein said first member, said second member and said biasing means are made from the same plastic material.

43. The display holder according to claim 41 wherein said biasing means is made from a different plastic material than said first member.

44. The display holder according to claim 41 wherein said first member and said second member are provided with integral and mating hinge formations, said first member and said second member being assembled together in pivotal relationship.

45. The display holder according to claim 41 wherein said first member and said second member are each attached to said biasing member at one position and pivotally attached together at another position.

46. The display holder according to claim 41 wherein said biasing means provides a first biasing force when said second member is in said closed position, and a second biasing force when said second member is in said open position.

47. The display holder according to claim 46 wherein said first biasing force is an over-center force and said biasing means is bowed toward said second member.

48. The display holder according to claim 46 wherein said second biasing force is in a direction urging said second member toward said open position.

49. The display holder according to claim 41 wherein said means for holding said display piece is defined by at least one of said first and second members.

50. The display holder according to claim 41 wherein said means for holding said display piece comprises a relatively softer material than said second member.

51. The display holder according to claim 41 further comprising a backing member secured to said first member.

52. The display holder according to claim 41 wherein said first member, said second member and said biasing means comprise a frame section for assembly with a plurality of other frame sections to form a polygonal frame structure.

53. The display holder according to claim 41 wherein said hinge means is integrally formed on at least one of said first and second members.

54. A display holder for receiving a display piece comprising:

a first member, a second member movable with respect to said first member between relatively open and relatively closed positions, resilient biasing means integrally attached to both said first member and said second member for connecting them together, means for holding said display piece, and backing member secured to said first member, 'said first member, said second member and said biasing means being made of extruded plastic material and being integrally formed together at the time of extrusion, said first and second members comprising relatively rigid material and said biasing means comprising relatively softer material and being elastic and resilient, said biasing means providing a force urging said second member toward said closed position.

55. A display holder for receiving a display piece comprising:

a first member, a second member movable with respect to said first member between relatively open and relatively closed positions, resilient biasing means integrally attached to both said first member and said second member for connecting them together, and means for holding said display piece, said first member, said second member and said biasing means being made of extruded plastic material and being integrally formed together at the time of extrusion, said first and second members comprising relatively rigid material and said biasing means comprising relatively softer material and being elastic and resilient, said biasing means providing a force urging said second member toward said closed position, and wherein said first member, said second member and said biasing means comprise a frame section for assembly with a plurality of other frame sections to form a polygonal frame structure.

56. A display holder for receiving a display piece comprising:

a first member, a second member, hinge means for pivotally connecting said first and second members, said second member being movable with respect to said first member between relatively open and relatively closed positions, resilient biasing means integrally attached to both said first member and said second member for connecting them together, means for holding said display piece, and backing members secured to said first member, said first member, said second member and said biasing means being made of extruded plastic material and being integrally formed together at the time of extrusion, said first member and said second member comprising relatively rigid material and said biasing means comprising relatively softer material and being elastic and resilient, said biasing means providing a force for urging said second member toward said closed position.

57. A display holder for receiving a display piece comprising:

a first member, a second member, hinge means for pivotally connecting said first and second members, said second member being movable with respect to said first member between relatively open and relatively closed positions, resilient biasing means integrally attached both said first member and said second member for connecting them together, and means for holding said display piece, said first member, said second member and said biasing means being made of extruded plastic material and being integrally formed together at the time of extrusion, said first member and said second member comprising relatively rigid material and said biasing means comprising relatively softer material and being elastic and resilient, said biasing means providing a force urging said second member towards said closed position, and wherein said first member, said second member and said biasing means comprise a frame section for assembly with a plurality of other frame sections to form a polygonal frame structure.

* * * * *